US006471548B2

(12) United States Patent
Bertoncini et al.

(10) Patent No.: US 6,471,548 B2
(45) Date of Patent: Oct. 29, 2002

(54) SHIELDED HEADER

(75) Inventors: Daniel B. Bertoncini, Mechanicsburg, PA (US); Stuart C. Stoner, Lewisberry, PA (US); Ray C. Doutrich, Lebanon, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/841,227

(22) Filed: Apr. 24, 2001

(65) Prior Publication Data

US 2002/0025721 A1 Feb. 28, 2002

Related U.S. Application Data

(63) Continuation of application No. 09/311,349, filed on May 13, 1999, now Pat. No. 6,220,896.

(51) Int. Cl.[7] ..... H01R 13/648
(52) U.S. Cl. ..... 439/608
(58) Field of Search ..... 439/608, 609, 439/620, 108, 78, 101, 83, 607

(56) References Cited

U.S. PATENT DOCUMENTS

| | | | | |
|---|---|---|---|---|
| 3,399,372 A | | 8/1968 | Uberbacher | |
| 3,482,201 A | * | 12/1969 | Schneck | 439/108 |
| 3,587,028 A | | 6/1971 | Uberbacher | |
| 4,157,612 A | | 6/1979 | Rainal | 29/628 |
| 4,407,552 A | * | 10/1983 | Watanabe et al. | 439/143 |
| 4,571,014 A | | 2/1986 | Robin et al. | |
| 4,846,727 A | | 7/1989 | Glover et al. | 439/608 |
| 4,975,066 A | | 12/1990 | Sucheski et al. | 439/63 |
| 4,975,069 A | | 12/1990 | Fedder et al. | 439/101 |
| 5,141,455 A | | 8/1992 | Ponn | 439/620 |
| 5,174,770 A | | 12/1992 | Sasaki et al. | 439/108 |
| 5,228,864 A | | 7/1993 | Fusselman et al. | 439/108 |
| 5,586,912 A | | 12/1996 | Eslampour et al. | 439/620 |
| 5,620,340 A | | 4/1997 | Andrews | 439/608 |
| 5,713,767 A | | 2/1998 | Hanson et al. | 439/853 |
| 5,820,392 A | * | 10/1998 | Lin et al. | 439/108 |
| 5,882,227 A | | 3/1999 | Neidich | 439/608 |
| 6,007,376 A | | 12/1999 | Shimizu | 439/571 |
| 6,220,896 B1 | * | 4/2001 | Bertoncini et al. | 439/648 |

* cited by examiner

*Primary Examiner*—Neil Abrams
*Assistant Examiner*—J. F. Duverne
(74) *Attorney, Agent, or Firm*—Woodcock Washburn LLP

(57) ABSTRACT

A header for interconnecting electrical components comprises at least one column of conductors interposed between ground planes, wherein the column of conductors comprises at least a first, second and third conductor. The first conductor is a ground line, the second and third conductors are signal lines, and the first conductor is electrically connected to one of the ground planes, wherein the second conductor is positioned in the column in interposed relation between said first and third conductor.

11 Claims, 4 Drawing Sheets

SHIELDED HEADER

This is a continuation of Ser. No. 09/311,349, filed May 13, 1999, now U.S. Pat. No. 6,220,896.

FIELD OF THE INVENTION

The present invention relates to electrical connectors, and more particularly to modular connectors for connecting daughter printed wiring boards to mother printed wiring boards.

BACKGROUND OF THE INVENTION

In the manufacture of computers and other electronic apparatus, daughter printed wiring boards (PWBs) are commonly connected to mother PWBs by means of modular electrical connectors, typically comprising a receptacle and a header. A daughter card (or PWB) electrically and mechanically connects to a receptacle, which in turn electrically and mechanically connects to a mother card (or backplane).

Modular electrical connectors of the type mentioned above are used, for example, to connect a large number of signal wires to a PWB. Consequently, a connector is provided with a number of columns of contact holes with contact pins disposed therein. An exemplary connecter is an 8×12 connector which has 12 columns of 8 contact holes with contact pins disposed therein.

As miniaturization becomes more prevalent, the number of signal wires to be connected to a connector increases, but the dimensions of the connector itself must not increase and preferably should even decrease. This results in an increasing number of signal and ground connections in the limited space of the connector. In high-frequency applications, this results in the risk of cross talk in the signal connections.

Accordingly, to combat the risk of cross talk due to mutual EMI of the signal connections, electrical connectors are equipped with shielding to attempt to shield each signal from EMI from neighboring and nearby signals. This shielding can be a conventional mechanical shield or an electrical shield in the form of a ground line. With today's electrical connectors, however, the current state of shielding still leaves great risk for cross talk. It is, therefore, desirable to provide an electrical connector that has enhanced shielding capabilities, yet does not significantly reduce signal density.

Stripline configurations, i.e., arrangements in which conductors in parallel in a dielectric are interposed between ground planes, are known in the art. A need exists for a way to use such configurations to reduce cross.

SUMMARY OF THE INVENTION

A header for interconnecting electrical components is provided. The header comprises at least one column of conductors interposed between ground planes, wherein the column of conductors comprises at least a first, second and third conductor. The first conductor is a ground line, the second and third conductors are signal lines, and the first conductor is electrically connected to one of the ground planes, wherein the second conductor is positioned in the column in interposed relation between said first and third conductor.

In alternate embodiments, the header for interconnecting electrical components comprises a plurality of rows and columns of signal lines, wherein at least one column comprises at least one ground line situated between two signal lines so that the ground line is coplanar with the signal lines.

A ground plane for providing at least one ground line throughout a header for interconnecting electrical components also is provided. The ground plane comprises at least one substantially vertically-oriented metal shield section for separating signal lines of adjacent columns and at least one substantially horizontally-oriented ground shield, through which a ground line that carries a ground current passes.

DETAILED DESCRIPTION OF THE PREFERRED EMBODIMENTS

Figure 1:
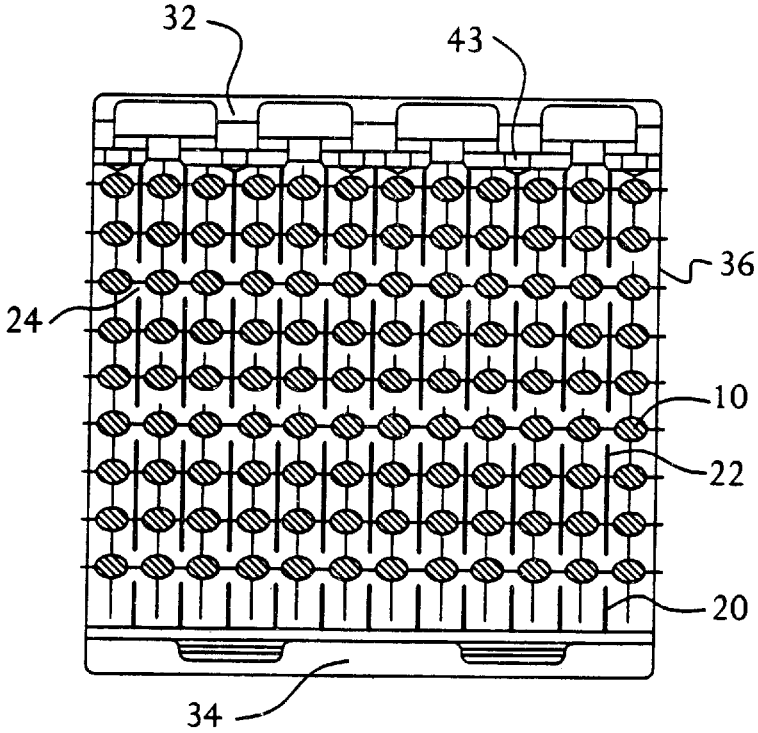
FIG. 1 is a top view of a preferred embodiment of a header of the present invention.

A header for connecting a receptacle to a mother printed wiring board (PWB) and having an improved shielding design is provided. A top view of a preferred embodiment of a header of the present invention is shown in FIG. 1. This preferred header is an 8×12 header, having twelve columns of eight contact holes, in which are disposed contact pins 10, each of which can carry a signal. It will be understood that the terminology 8×12 is used even though the drawings show 9 rows of contacts since only 8 rows of contacts on the header mate with contacts on the receptacle while one row of contacts on the header is grounded to a metallic shield on the receptacle. Alternatively, the 8 rows may be any number of rows of preferably at least 5 rows. Also, the 12 columns may alternatively be any number of columns which is a multiple of 3.

Figure 2:
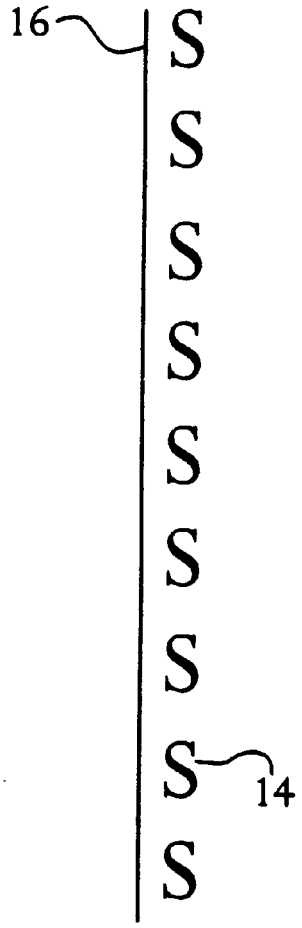
FIG. 2 (PRIOR ART)
FIG. 2 is a schematic of a conventional column of eight signal lines from an 8×12 header.

A schematic of a conventional column of signal lines from an 8×12 header is shown in FIG. 2. The conventional column of FIG. 2 has signal lines 14, and a vertically-oriented shield 16 separating the columns of signals from each other. This conventional design provides limited protection against cross talk between signal connections.

Figure 3:
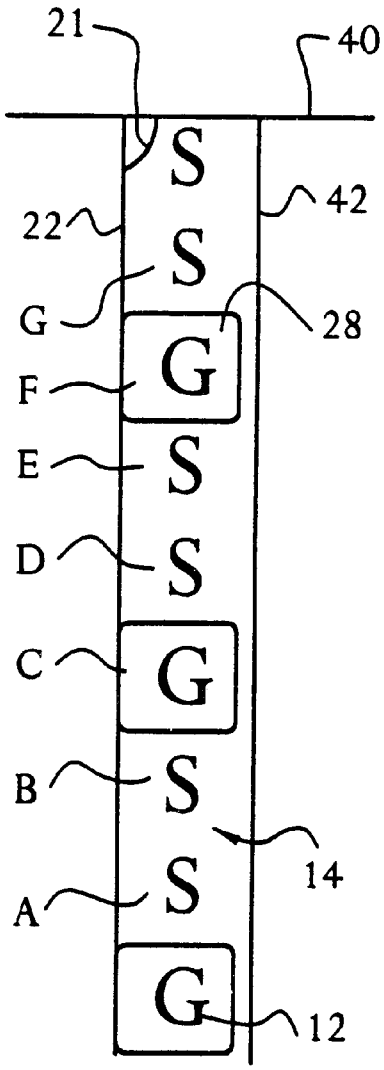
FIG. 3 is a schematic of a column of signal lines of the present invention for an 8×12 header.

A schematic of a column of signal lines of the present invention is shown in FIG. 3. From ground line 12, there are two signal lines generally A and B (generally at 14), followed by a ground line C, two more signal lines D and E, followed by a ground line F, and then two more signal lines G and H. In addition, there are substantially vertically-oriented metal shields 22 and 42 adjacent the signal lines 14 and substantially horizontally-oriented metal shields 28 surrounding the ground lines 12, C and F. This new design provides enhanced protection against cross talk between signal connections. Preferably, these differential pairs of signal lines 14 are used with high speed signals and are offset 180 degrees. As is known in the art, when differential pair signals are offset by 180 degrees, noise in one signal tends to be cancelled by the noise in the other signal. A further explanation of differential pairs is found at pages 267–268 and 319–320 of "High-Speed Digital Design," by Howard W. Johnson et al. (Prentice Hall, 1993), the contents of which are incorporated herein by reference.

Still referring to FIG. 3, parallel shield sections 22 and 42 are positioned to opposed sides of the ground and signal line conductors. A tab 21 is also used to contact the shield 22 to ground spring element 40 which is also in contact with shield section 42. It will be appreciated that the ground shield sections 22 and 42 will affect the electromagnetic field around each signal line 14 so as to reduce cross talk between adjacent signal lines 14. It will also be seen that the ground lines as at lines 12, C, F at 28 are electrically connected to the shield 22 which will have the effect of further affecting the electromagnetic fields surrounding the signal lines 14 so as to still further enhance cross talk reduction. The tab 21 further enhances grounding and cross talk reduction by allowing ground current from shield section 22 to be further distributed to ground spring element 40 and thus other shield sections such as shield section 42.

Figure 5:
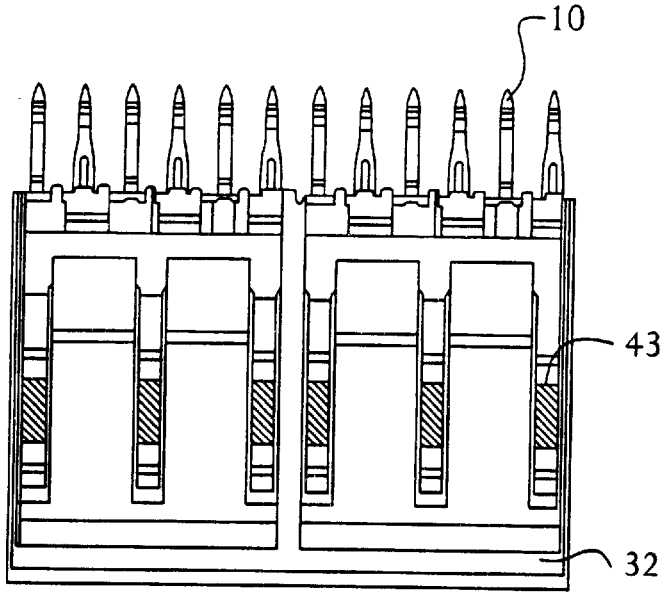
FIG. 5 is an inverted rear view of the header of FIG. 1.
Figure 4:
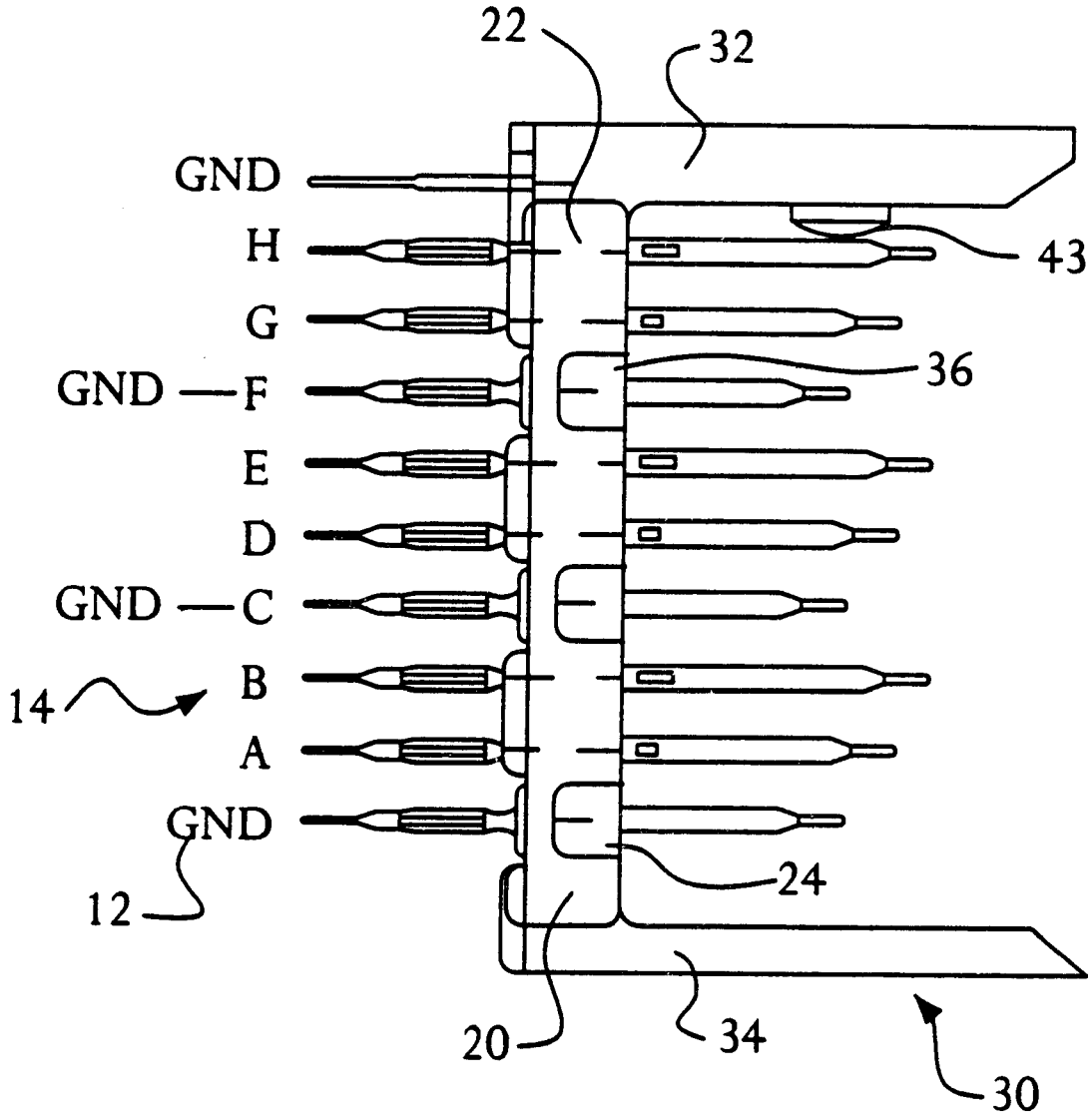
FIG. 4 is a cross-sectional side view of the header of FIG. 1.

FIG. 4 shows a cross-sectional side view of the header of FIG. 1. Shown in FIG. 4, there is a column comprised of a ground line 12, which mates with a grounding shield (not shown) on the receptacle, signal lines A, B, D, E, G and H (generally at 14), and ground lines C and F, which mate with contacts on the receptacle. FIG. 4 also shows the metal shield 20, which comprises shields sections 22 situated between the columns of signal contact pins 10 at the location of the signal lines 14. Slots 24 also are present between the metal shield sections 22 where the ground lines 12, C and F are located. FIG. 4 also shows the plastic housing 30, comprising the three walls 32, 34 and 36. FIG. 5 shows an inverted rear view of the header of FIG. 1.

Figure 6:
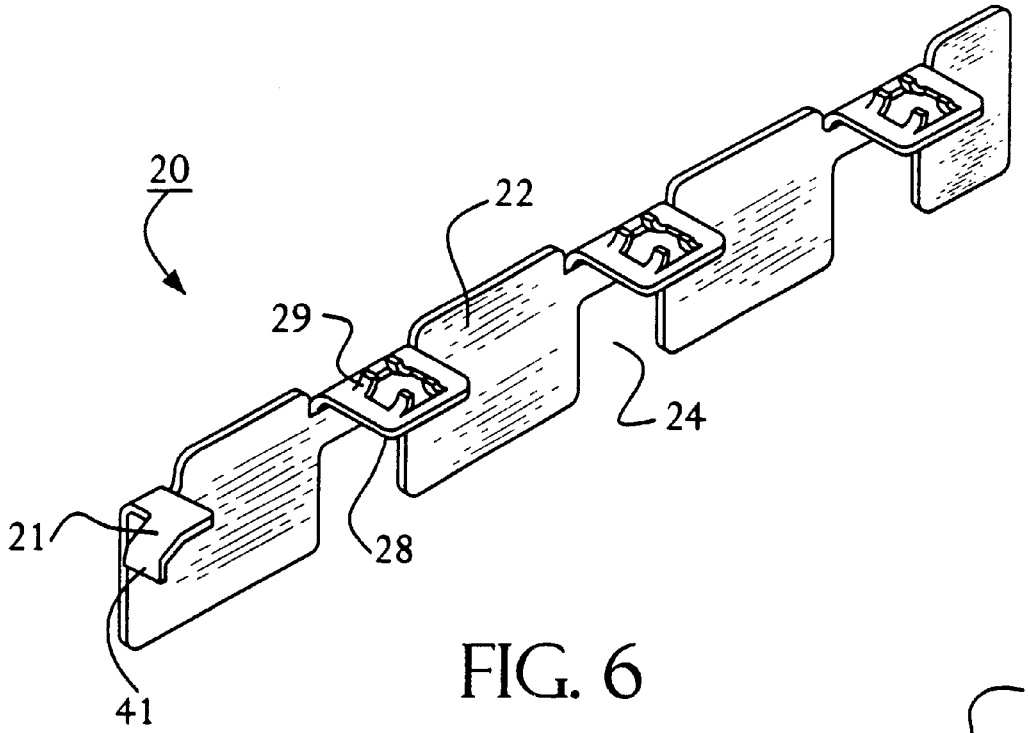
FIGS. 6 and 7 are the two side isometric views of the ground plane of the present invention.
Figure 7:
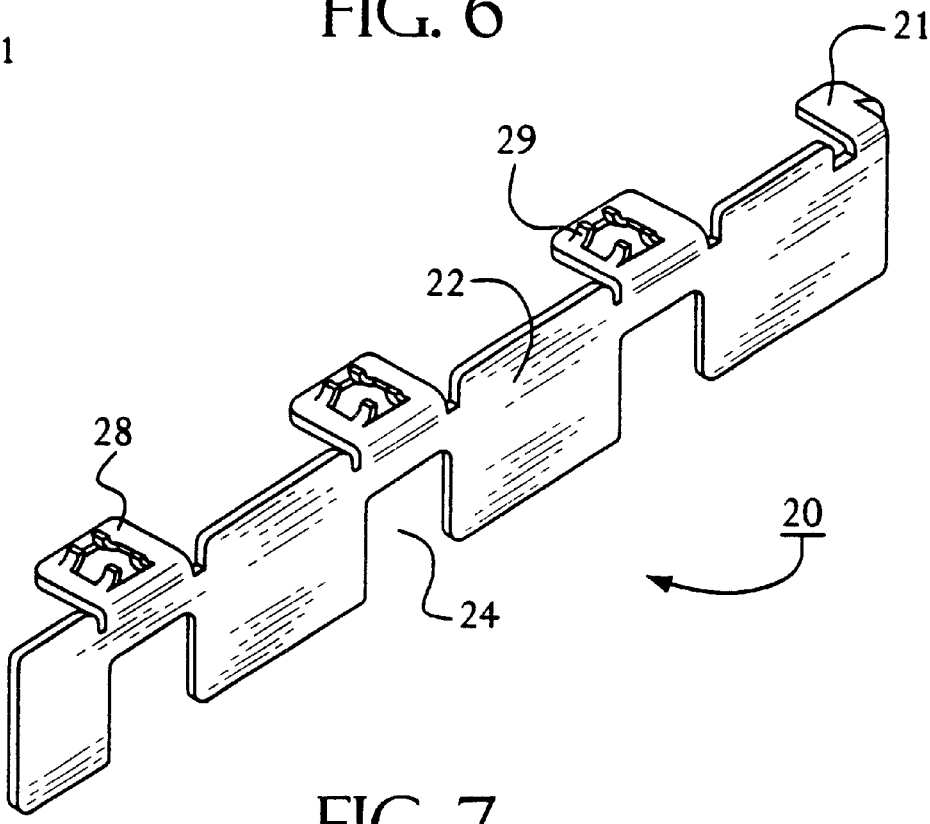

The metal shield 20 of the present invention, referred to as a ground plane 20, is shown in FIGS. 6 and 7 in the two side isometric views. FIGS. 6 and 7 depict the metal shield sections 22, the slots 24 between the shield sections 22, and ground shields 28, through which the signal contact pins 10 (or signal lines 10) that carry the ground lines 12, C and F pass. Preferably, a ground plane 20 is one member. For example, the ground plane 20 alternatively may be described as a metal shield plate having slots 24 and ground shields 28 perpendicularly attached to the plate just above the location of the slots 24.

The metal shield sections 22 are substantially rectangularly-shaped and are substantially vertically-oriented. The ground shields 28 are substantially rectangularly-shaped and are substantially horizontally-oriented. Preferably, the ground shields 28 are oriented at approximately 90 degrees to the metal shield sections 22. Each ground shield 28 has four rectangularly-shaped corner tabs 29 that are bent (or curved) upward so that the ground planes 20 can be situated around the signal contact pins 10 without causing damage to the pins 10. Preferably, the ground shields 28 attach to the pins 10.

The header of the present invention is also equipped with spring arms 43 which are situated on housing wall 32, as depicted in FIGS. 1, 4 and 5. These spring arms 43 have a mechanical function and a grounding function. The spring arms 43 mechanically receive the connecting receptacle, to which the daughter card connects. The spring arms 43 also provide an electrical link to the grounding signals 12 of each ground plane 20 by abutting each ground plane 20. As shown in FIG. 6 and 7, each ground plane 20 has a connecting tab 21 which, by way of each tab's distal end 41, electrically connects each ground plane 20 to the series of spring arms 43. In the embodiment of FIG. 1, this 8×12 header preferably has 6 springs, as shown in FIGS. 1 and 5.

The header design of the present invention reduces cross talk between signal lines 14 by providing a 2:1 signal line 14 to ground line 12, C and F ratio. The header of the present invention also has a conventional footprint that allows it to be used as a header for conventional connectors. The slotted design of the ground shields also allows for more plastic to be present than otherwise be present without the slots 24, as depicted in FIG. 1. This strengthens the existing electrical insulation provided by the plastic, thereby further reducing the risk of cross talk. It will also be appreciated that the header of the present invention, by making use of ground planes, allows for the use of fewer ground connections to the printed circuit board. Because fewer pins need to be used for grounding, more pins can be used as signal pins, thereby allowing for more signal density.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. A ground plane for providing at least one ground line throughout a header for interconnecting electrical components, the header having rows and columns of parallel lines, the ground plane comprising:

at least one metal shield section for separating lines of adjacent columns; and at least one ground shield, through which a ground line that carries a ground current passes, said at least one ground shield being substantially transverse to the lines and wherein the at least one ground shield engages said ground line.

2. The ground plane of claim 1 comprising:

a plurality of metal shield sections;

a plurality of open slots situated between the shield sections; and a plurality of ground shields, the ground shields being situated substantially between the shield sections.

3. The ground plane of claim 2, wherein:

each shield section is substantially rectangularly-shaped; and each ground shield is substantially rectangularly-shaped.

4. The ground plane of claim 2, wherein:

each ground shield has shield tabs that project upward so that the ground planes can be situated around the ground lines without causing damage to the lines.

5. The ground plane of claim 4, wherein there are four tabs that are rectangular-shaped, each shield tab being situated at approximately each corner of the ground shield.

6. The ground plane of claim 2 further comprising a connecting tab extending from an end of the ground plane and having a distal end for electrically connecting the ground plane to a series of springs.

7. The ground plane of claim 1, wherein said at least one metal shield section is oriented substantially vertically.

8. The ground plane of claim 1, wherein said at least one ground shield section is oriented substantially horizontally.

9. The ground plane of claim 1, wherein said at least one metal shield section is oriented substantially perpendicular to said at least one ground shield.

10. The ground plane of claim 1, wherein said at least one metal shield section is disposed between the lines of adjacent columns.

11. The ground plane of claim 1, wherein said at least one metal shield section is substantially parallel to the lines.

* * * * *